United States Patent [19]

Lennox

[11] 4,018,119

[45] Apr. 19, 1977

[54] FILM SLITTING APPARATUS

[75] Inventor: Forrest R. Lennox, Coleman, Mich.

[73] Assignee: The Dow Chemical Company, Midland, Mich.

[22] Filed: May 4, 1976

[21] Appl. No.: 682,935

[52] U.S. Cl. ..... 83/425.3; 83/434; 83/425; 83/407; 83/860; 83/436; 83/435

[51] Int. Cl.[2] ..... B26D 5/02; B26D 7/06

[58] Field of Search ..... 83/425, 425.2, 435, 83/434, 407, 425.3, 436, 860

[56] References Cited

UNITED STATES PATENTS

| | | | |
|---|---|---|---|
| 417,268 | 12/1889 | McCarter | 83/435 |
| 773,563 | 11/1904 | Ginn | 83/435 |
| 1,321,228 | 11/1919 | Midgley | 83/425 |
| 2,552,674 | 5/1951 | Haren | 83/434 |

*Primary Examiner*—Donald R. Schran
*Attorney, Agent, or Firm*—Earl D. Ayers

[57] ABSTRACT

The invention comprises a roller having circumferentially extending slits through which extend blades having an outerwardly facing cutting surface. The blades are detachably mounted from a retractable bar whereby the cutting surface extends beyond the roller or is retracted below the outer surface of the roller. A pivoted protective cover assembly fits adjacent to the slitted rollers and retracts the blades when the cover is lifted away from the slitted roller. Means are provided to position the slitted roller laterally with respect to the film to be slitted.

6 Claims, 2 Drawing Figures

FILM SLITTING APPARATUS

BACKGROUND OF THE INVENTION

This invention relates to slitting apparatus and particularly to such apparatus wherein a plastic film to be rolled onto a roll form is slitted by knives cooperating with a slitting roll.

It is well-known in the film slitting art to slit film by a fixed mounted knife edge extending downwardly through a moving film surface with part of the cutting edge of the knife extending downwardly into a slit in the roller over which the film passes. This type of slitter has disadvantages. The knife edges are exposed when one works around the equipment unless the knives are removed.

Adjustment of the position of the knife edge is accomplished by individual adjustment of the blades. This is time consuming, since the part of the cutting edge in contact with the film tends to become dull and frequently needs to be changed.

Changing the lateral position of the cutting edge with respect to a film roll is also difficult since the cutting element is fixedly coupled to a support structure.

Objects of the Invention

A principal object of this invention is to provide an improved film slitting assembly.

Another object of this invention is to provide an improved, safer to use, film slitting assembly.

A further object of this invention is to provide an improved, easier to use, film slitting assembly.

Statement of Invention

In accordance with this invention, there is provided a film cutting assembly comprising a roller having circumferentially extending slots through which extend blades having an outwardly facing cutting surface. The blades are retractably mounted from a retractable bar whereby the cutting surface extends beyond the roller or is retracted below the outer surface of the roller. A pivoted protective cover assembly fits adjacent to the slitting rollers and retracts the blades when the cover is lifted away from the slitting roller. Means are provided to position the slitting roller laterally with respect to the film to be slitted.

BRIEF DESCRIPTION OF THE DRAWINGS

The invention, as well as additional objects and advantages thereof, will best be understood when the following detailed description is read in connection with the accompanying drawing, in which.

DETAILED DESCRIPTION OF THE DRAWING

Figure 1:
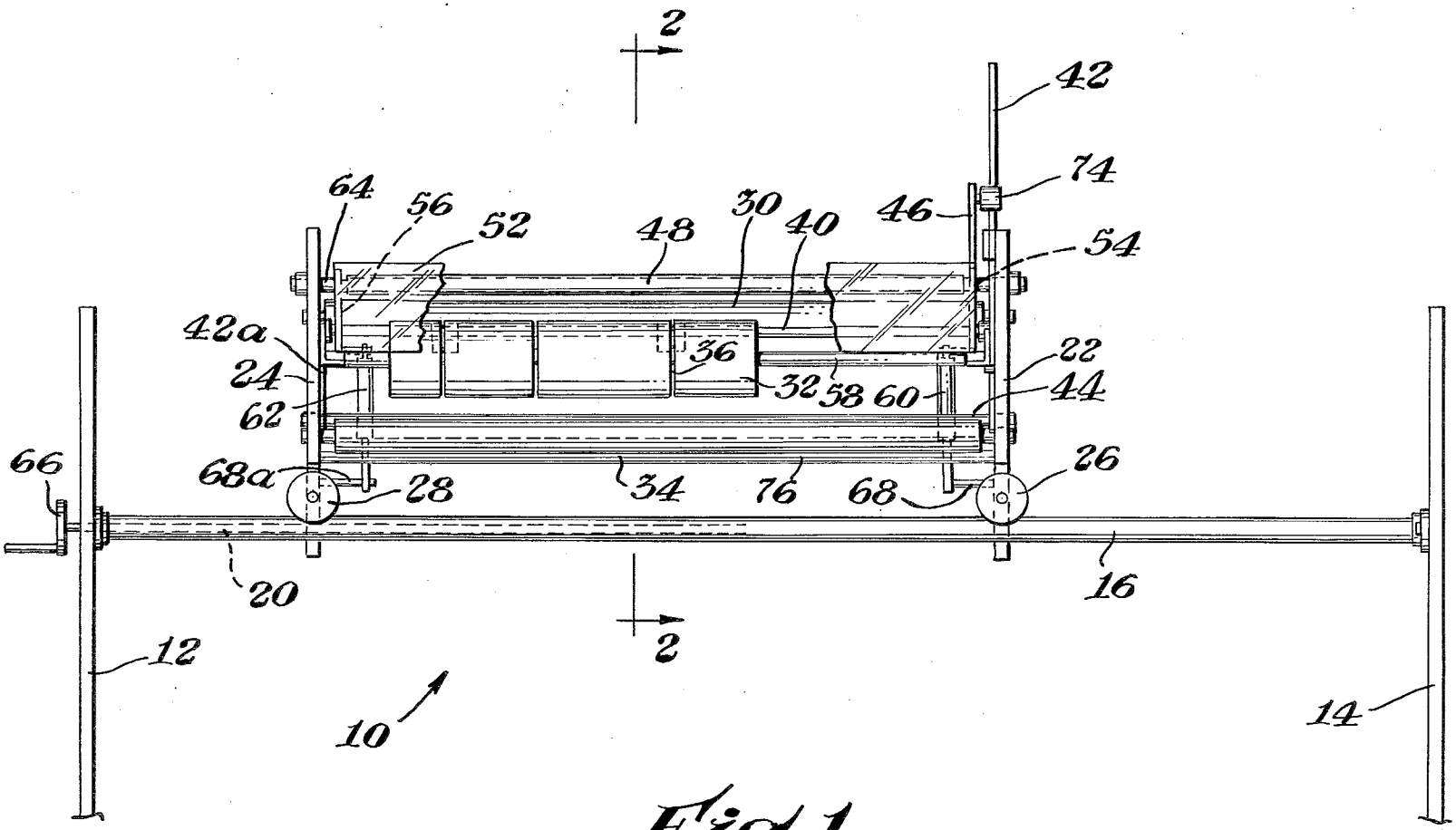
FIG. 1 is a side elevational view, partly broken away, of the film slitting assembly of this invention.
Figure 2:
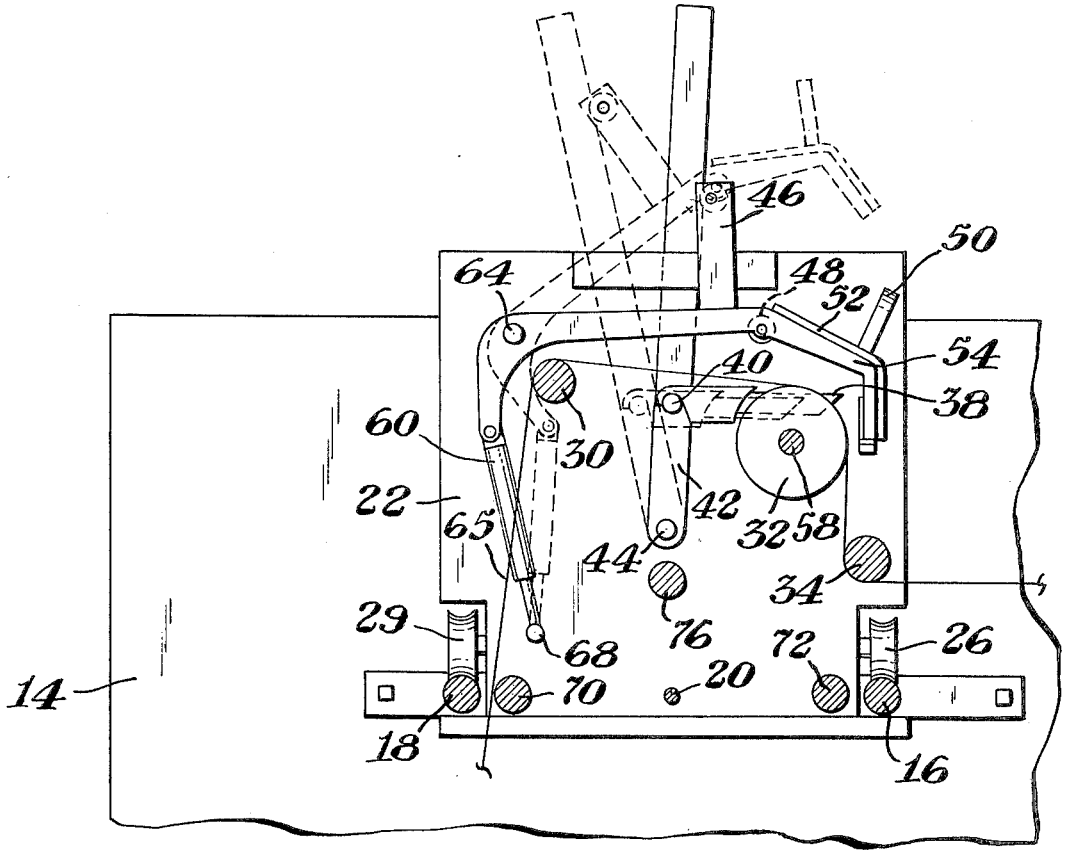
FIG. 2 is a sectional view taken through the line 2—2 of FIG. 1.

Referring to the drawings, the film slitting apparatus or assembly, indicated generally by the numeral 10, is supported by at least four rollers (26, 28 and 29 are shown in the drawings) on rod-like bar numbers 16, 18 which extend between rigid plate-like frame members 12, 14. Each of the rollers is rotatably coupled to the end of a frame plate 22 or 24 of the assembly 10.

The plates 22, 24 are held in fixed spaced apart relationship by bars 70, 72, 76. The assembly 10 may be moved laterally along the bar members by rotation of the handle 66 on the external end of a threaded rod 20 which passes through and engages a threaded bore in the plate 22.

A rotatable film slitting roll 32 is carried on shaft 58 which extends between the plates 22, 24. The roll 32 has circumferentially extending grooves 36 therein which are deeper than the top to bottom dimension of knife blades 38 which extend into the grooves. The knife blades 38 are rotatably and detachably coupled at their rear end parts to a rod 40 which is fixedly coupled between bars 42, 42a which in turn are rotatably coupled at their lower end parts to a bar 44 which is coupled to the frame members 22, 24, respectively. The bar 42 extends upwardly well beyond the rod 40 and above the top of the plate 22 to serve as a handle for use in advancing and retracting the knives 38. A retractable safety cover assembly composed of two spaced apart somewhat U-shaped bars 54, 56 having a transparent safety cover 52 disposed between them. The bars 54, 56 are disposed adjacent to the plates 22, 24, respectively, and are pivotally mounted near the rear of the base of the U of the rods on a bar 64 which extends between the plates 22, 24. The bar 64 is disposed above and substantially to the rear of the roller 32. Spring units 60, 62 are coupled between the rear end of the bars 54, 56, respectively and the rod-like elements 68, 68*a*, respectively which are coupled to one of the end plates 22, 24.

A bar 46, rigidly coupled to bar 54, extends upwardly and has a contact element 74 extending outwardly in the path of the bar 42 whereby the advancement of the knives causes the safety cover 52 to be advanced.

A roller 30 is supported between the end plates 22, 24 back of the knife holding mechanism and above the slitting roll 32. A similar roller 34 is disposed below the slitting roller 32 between the end plates 22, 24.

The film 65 to be slit passes over the roller 30, slitting roller 32 and under and around roller 34 during the operation of the apparatus.

Operation

With the film to be slit passing through the apparatus as set forth above, the grooves 36 and knives 38 are aligned to provide the correct film width after slitting. The slits in the roller 32 may be conveniently provided by separating roller segments by a suitable washer, for example. The entire slitting assembly may be moved laterally with respect to the film strip by turning the crank 66 which rotates the threaded rod 20 which is coupled to the end plate 24.

The rod 42 is then moved in the direction of roller 32, advancing the knives 38 so their sharp upper edges extend out of the slits 36 in the roller 32 and puncture the film 38.

As the knives are advanced, the safety cover is pivoted downwardly (through contact between bar 42 and bar 46) to cover the knives and roller 32 from above.

The film 65 is power drawn through the apparatus 10 and onto a roll form by powered means (not shown).

The continual use of a knife edge as a slitter dulls the blade. This apparatus permits use of various sections of the cutting edge of the knife 38 by changing the position of the bar 42 to slightly advance or retract the knife edge.

Additionally, it is easy to change knives by lifting them from the rod 40, since accuracy of slit dimensions is maintained by simply placing the knife blade in the slit 36.

The various segments of the roller preferably are individually rotatable on the shaft 58. This permits the washer 5 on which the knife blades bear to be non-rotatable with respect to the shaft 58.

What is claimed is:

1. Film slitting apparatus comprising a frame comprising side members maintained in fixed position with respect to each other, means for laterally moving said side members, a slitted roll, said slitted roll being rotatably supported between said side members, an array of knives each of which has a cutting edge, knife supporting means extending between said side members adjacent to said slitted roll, each of said knives being coupled to said knife supporting means with its blade extending into a slit in said slitted roll, the cutting edge of said blade extending towards the outer surface of said roll, and means for moving said knife supporting means toward and away from said slitted roll.

2. Apparatus in accordance with claim 1, wherein a pivotally mounted safety cover is coupled between said side members and above said slitted roll.

3. Apparatus in accordance with claim 2, wherein means are provided for advancing and retracting said safety cover with respect to said slitted roll.

4. Apparatus in accordance with claim 3 wherein said means for moving said knife supporting means toward and away from said slitted roll is coupled to said means for advancing and retracting said safety cover as said knife supporting means is advanced.

5. Apparatus in accordance with claim 1, wherein said knives are quickly detachably coupled to said knife supporting means.

6. Apparatus in accordance with claim 1, wherein said slitted roll comprises a plurality of roll segments rotatable on said shaft and separated by spacer means which each define a slit.

* * * * *